US005323617A

United States Patent [19]

Ichikawa

[11] Patent Number: 5,323,617

[45] Date of Patent: Jun. 28, 1994

[54] AIR-CONDITIONING APPRATUS HAVING PLURALITY OF INDOOR UNITS CONNECTED TO HEAT SOURCE UNIT

[75] Inventor: Yasunori Ichikawa, Fuji, Japan

[73] Assignee: Kabushiki Kaisha Toshiba, Kawasaki, Japan

[21] Appl. No.: 83,689

[22] Filed: Jun. 30, 1993

[30] Foreign Application Priority Data

Aug. 25, 1992 [JP] Japan ..... 4-225965

[51] Int. Cl.[5] ..... F25B 49/00

[52] U.S. Cl. ..... 62/129; 62/160; 62/197; 62/196.3

[58] Field of Search ..... 62/197, 160, 129, 126, 62/125, 127, 196.3, 196.4, 199, 200

[56] References Cited

U.S. PATENT DOCUMENTS 5,009,076 4/1991 Winslow ..... 62/129
5,044,168 9/1991 Wycoff ..... 62/126
5,186,014 2/1993 Runk ..... 62/160 x
5,241,833 9/1993 Onkoshi ..... 62/129 X

FOREIGN PATENT DOCUMENTS 4-148170 5/1992 Japan .
4-222358 8/1992 Japan .

*Primary Examiner*—Harry B. Tanner
*Attorney, Agent, or Firm*—Cushman, Darby & Cushman

[57] ABSTRACT

According to this invention, a plurality of indoor units each having an indoor heat exchanger are connected to a heat source unit having a compressor and a water heat exchangers, thereby constituting a multi-type air-conditioning apparatus. The heat source unit has an operation switch operated when a refrigerant amount is to be checked. When the operation switch is turned on, the refrigerant discharged from the compressor is circulated in only the heat source unit. At this time, the temperature of predetermined positions in the heat source unit is detected by a temperature sensor, and it is determined, in accordance with the detection temperature, whether the refrigerant amount in a refrigerating cycle is normal or abnormal. The determination result is displayed on a display unit of the heat source unit.

11 Claims, 13 Drawing Sheets

TEMPERATURE (°C)
60
40
20
0
Td
Tcp
12°C~16°C
Ts

PRESSURE (Kg/cm2·G)
20
10
0
Td
Ts

F (Hz)
100
0
TIME

AIR-CONDITIONING APPRATUS HAVING PLURALITY OF INDOOR UNITS CONNECTED TO HEAT SOURCE UNIT

BACKGROUND OF THE INVENTION

1. Field of the Invention

The present invention relates to a multi-type air-conditioning apparatus having a plurality of indoor units connected to a heat source unit.

2. Description of the Related Art

When a refrigerant is filled in a refrigerating cycle of an air-conditioning apparatus, and a refrigerant amount is small, the air-conditioning apparatus cannot be properly operated.

In general, when a simple refrigerating cycle is used, checking whether a refrigerant amount in the refrigerating cycle is enough to operate the air-conditioning apparatus can be performed by detecting temperatures of parts of the refrigerating cycle, although the checking is difficult. As an example, an air-conditioning apparatus is described in Published Unexamined Japanese Patent Application No. 4-148170.

However, in a multi-type air-conditioning apparatus having a plurality of indoor units connected to a heat source unit, the arrangement of the refrigerating cycle is complicated, and there are a large number of combinations of the shapes and capacities of the indoor units. For this reason, a refrigerant amount cannot easily be determined in consideration of an indoor environment.

It is assumed that a protector is operated due to any abnormal operation in a test operation of the apparatus after the apparatus is installed and that the operation is stopped. In this case, assuming that a lack of refrigerant may cause the abnormal operation, although it is not known that the lack practically causes the abnormal operation, a normal amount of refrigerant must be recharged into the refrigerating cycle.

In this case, installation of the apparatus is delayed, time and cost are wasted, and the reliability of an operator may be impaired. In addition, when the refrigerant is recharged, the refrigerant filled in the cycle may be discharged to the outer atmosphere. Even if flon gas (R-22) used as a refrigerant is excluded from objects of anti-pollution regulations, discharge of a large amount of flon gas, i.e., several tens Kg, adversely affects the environment.

An example of the air-conditioning apparatus having a plurality of indoor units connected to a heat source unit is described in Published Unexamined Japanese Patent Application No. 4-222358.

SUMMARY OF THE INVENTION

It is an object of the present invention to provide a multi-type air-conditioning apparatus, having a plurality of indoor units connected to a heat source unit, in which a refrigerant amount of a refrigerating cycle can be automatically and accurately detected, and an unnecessary recharging operation of a refrigerant is omitted, thereby shortening the time required for installation and reducing cost.

According to the present invention, there is provided an air-conditioning apparatus having a plurality of indoor units connected to a heat source unit, comprising:

a compressor, arranged in the heat source unit, for taking, compressing, and discharging a refrigerant;

a heat-source-side heat exchanger arranged in the heat source unit;

a plurality of indoor heat exchangers arranged in the plurality of indoor units;

a refrigerating cycle obtained by piping the compressor, the heat-source-side heat exchanger, and the plurality of indoor heat exchangers;

a by-pass unit for causing the refrigerant discharged from the compressor to pass through the heat-source-side heat exchanger, and causing the refrigerant passing through the heat-source-side heat exchanger not to flow into the plurality of indoor heat exchangers but to flow into a low-pressure side of the refrigerating cycle;

a detection unit for detecting a temperature of a predetermined position in the heat source unit during an operation of the by-pass unit; and a determination unit for determining, in accordance with a detection temperature of the detection unit, whether a refrigerant amount in the refrigerating cycle is normal or abnormal.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The first embodiment of the present invention will be described below with reference to the accompanying drawings.

Figure 1:
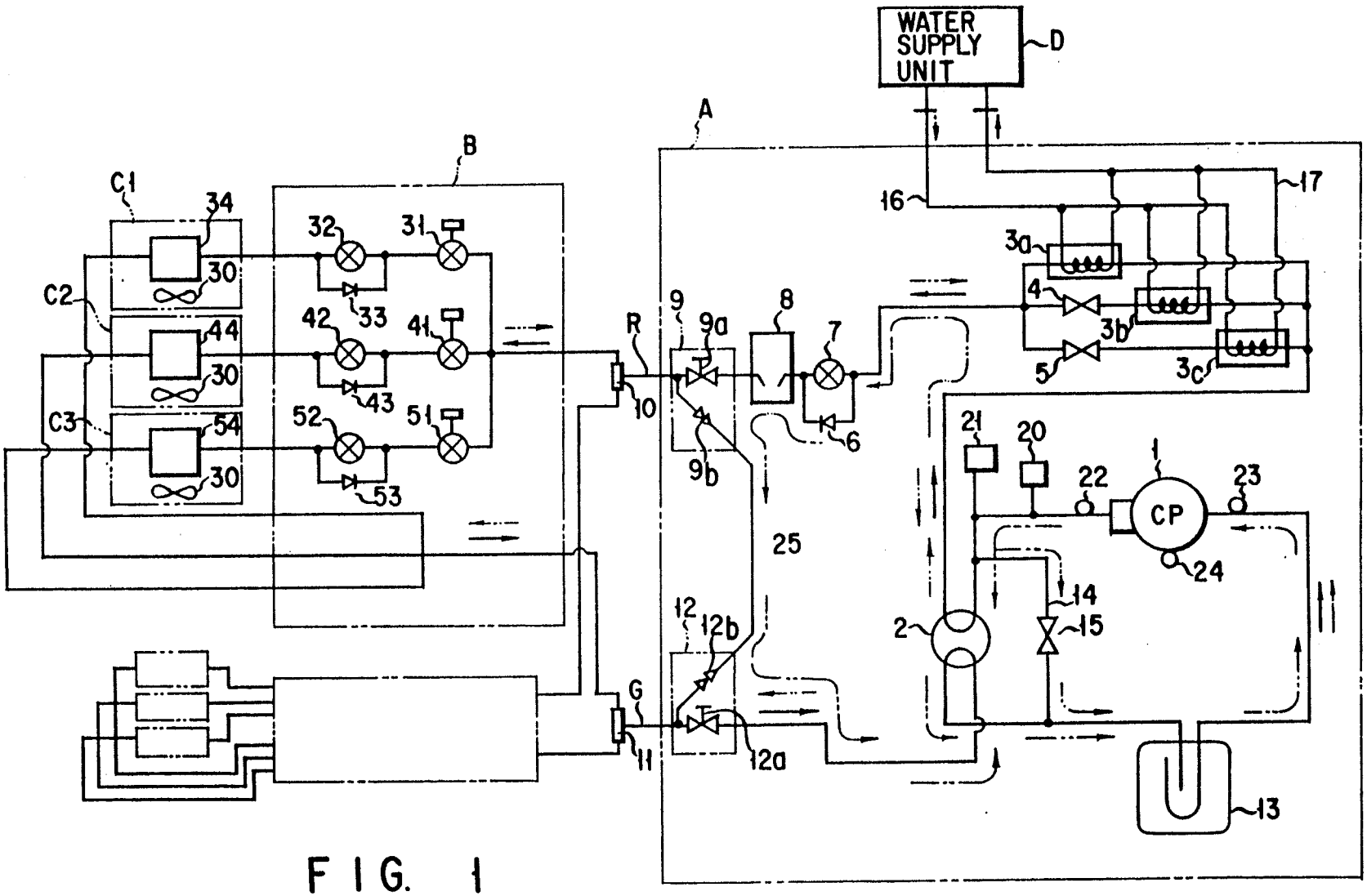
FIG. 1 is a view showing the arrangement of a refrigerating cycle according to the first embodiment of the present invention.
Figure 2:
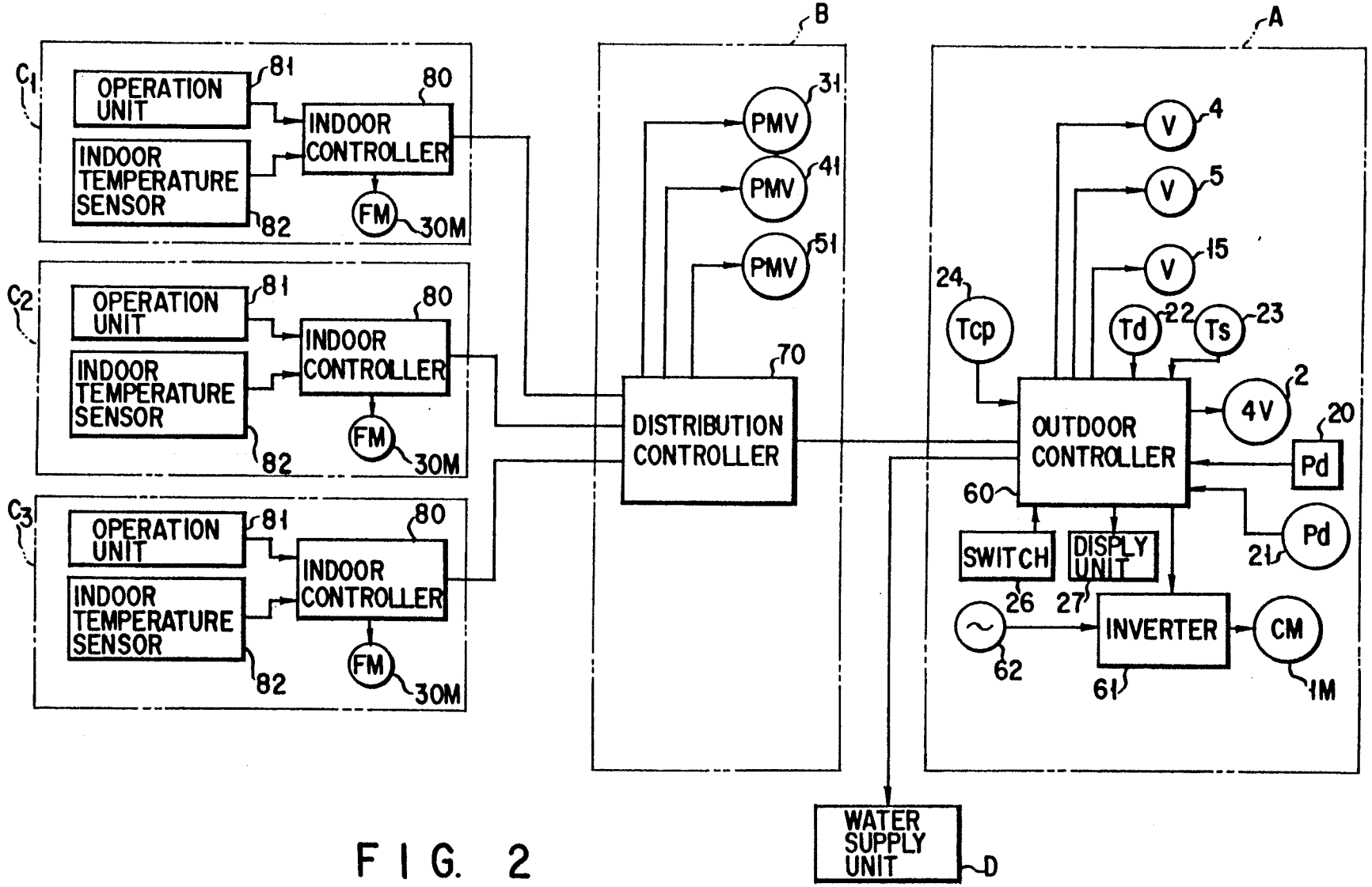
FIG. 2 is a block diagram showing a control circuit according to the first embodiment.

As shown in FIG. 1, a distribution unit B is piped to a heat source unit A. A plurality of indoor units $C_1$, $C_2$, and $C_3$ are piped to the distribution unit B.

These units A, B, $C_1$, $C_2$, and $C_3$ constitute the following heat-pump type refrigerating cycle.

The outdoor unit A has a variable-capability compressor 1. The compressor 1 takes a refrigerant from a suction port into a case, compresses the refrigerant, and discharges outside the case from a discharge port.

Heat-source-side heat exchangers, e.g., water heat exchangers 3*a*, 3*b*, and 3*c* having water as a heat source, are connected to the discharge port of the compressor 1 through an electromagnetic four-way valve 2. The four-way valve 2 is to switch the flow direction of the refrigerant, is set in a neutral state when it is not rendered conductive, and is switched when it is rendered conductive. The water heat exchangers 3*a*, 3*b*, and 3*c* are to exchange the heat of water supplied from a water supply unit D with the heat of the supplied refrigerant, and each of the water heat exchangers 3*a*, 3*b*, and 3*c* has a double-tube structure obtained by coaxially arranged a tube in which a refrigerant flows and a tube in which water flows. That is, the water heat exchangers 3*a*, 3*b*, and 3*c* can effectively exchange the heat of the refrigerant with the heat of the water by the double-tube structures.

The water heat exchangers 3*a*, 3*b*, and 3*c* are parallelly connected to each other with a header (not shown), and electromagnetic two-way valves 4 and 5 are connected to tubes connected to the water heat exchangers 3*b* and 3*c*, respectively.

A receiver 8 is connected to the water heat exchangers 3*a*, 3*b*, and 3*c* through a forward check valve 6. An expansion valve 7 for a heating operation is connected parallelly to the check valve 6.

A liquid-side packed valve 9 is connected to the receiver 8. The liquid-side packed valve 9 has a operation rod 9*a* for an opening/closing operation, and has a service port 9*b* which is open when the operation rod 9*a* is set to a predetermined position.

A header 10 is connected to a liquid-side tube R, and indoor heat exchangers 34, 44, and 54 of the indoor units $C_1$, $C_2$, and $C_3$ are connected to the header 10 through flow control valves 31, 41, and 51 and expansion valves 32, 42, and 52 of the distribution unit B, respectively. Check valves 33, 43, and 53 are connected parallelly to the expansion valves 32, 42, and 52, respectively. Indoor fans 30 are arranged near the indoor heat exchangers 34, 44, and 54, respectively. Each of the indoor fans 30 sucks indoor air and discharges it outside the room through the indoor heat exchangers 34, 44, and 54.

The tube R between the water heat exchangers 3*a*, 3*b*, and 3*c* and the indoor heat exchangers 34, 44, and 54 is a liquid line in which a liquid refrigerant flows. Pulse motor valves whose degrees of opening are changed depending on the number of supplied drive pulses are used as the flow control valves 31, 41, and 51, respectively. The flow control valves 31, 41, and 51 are to be referred to as PMVs hereinafter. The indoor heat exchangers 34, 44, and 54 exchange the heat of the supplied refrigerant with the heat of an indoor air.

A header 11 is connected to the indoor heat exchangers 34, 44, and 54, and a packed valve 12 is connected to the header 11. The packed valve 12 has an operation rod 12*a* for an opening/closing operation and a service port 12*b* which is open when the operation rod 12*a* is set to a predetermined position.

The suction port of the compressor 1 is connected to the packed valve 12 through the four-way valve 2 and an accumulator 13. The low-pressure-side tube G from the indoor heat exchangers 34, 44, and 54 to the suction port of the compressor 1 is a gas line in which a gas refrigerant flows.

The water supply unit D is connected to the water heat exchangers 3*a*, 3*b*, and 3*c* through water tubes 16 and 17. The water supply unit D includes a cooling tower and a water heater, cool water from the cooling tower or warm water from the water heater is supplied to the water heat exchangers 3*a*, 3*b*, and 3*c* with the water tube 16. The water supply unit D takes water discharged from the water heat exchangers 3*a*, 3*b*, and 3*c*.

In the refrigerating cycle with the above arrangement, the refrigerant flows in a direction of arrows of solid lines in a cooling operation mode to form a cooling cycle, at least one of the water heat exchangers 3*a*, 3*b*, and 3*c* functions as a condenser, and an indoor heat exchanger, generating an operation request, of the indoor heat exchangers 34, 44, and 54 functions as an evaporator.

In a heating operation mode, the refrigerant flows in a direction of arrows of dotted lines by switching the four-way valve 2 to form a heating cycle. Warm water is supplied from the water supply unit D to the water heat exchangers 3*a*, 3*b*, and 3*c*, an indoor heat exchanger, generating an operation request, of the indoor heat exchangers 34, 44, and 54 functions as a condenser, and at least one of the water heat exchangers 3*a*, 3*b*, and 3*c* functions as an evaporator.

One end of a by-pass tube 14 is connected to a high-pressure-side tube between the discharge port of the compressor 1 and the four-way valve 2, and the other end of the by-pass tube 14 is connected to a low-pressure-side tube between the four-way valve 2 and the accumulator 13. An electromagnetic two-way valve 15 is arranged in the by-pass tube 14.

A high-pressure switch 20, a pressure sensor 21, and a first temperature sensor 22 are arranged in the high-pressure-side tube between the discharge port of the compressor 1 and the four-way valve 2. A second temperature sensor 23 is arranged in a low-pressure-side tube between the accumulator 13 and the suction port of the compressor 1. A third temperature sensor 24 is arranged on the case of the compressor 1.

The high-pressure switch 20 is operated when the pressure, i.e., a high-pressure-side pressure Pd, of a refrigerant discharged from the compressor 1 is abnormally increased to exceed a predetermined value, and the high-pressure switch 20 constitutes a high-pressure protection means together with an outdoor controller 60 (to be described later). The pressure sensor 21 detects the pressure, i.e., the high-pressure-side pressure Pd, of the refrigerant discharged from the compressor 1. The first temperature sensor 22 detects a temperature Td of the refrigerant discharged from the compressor 1. The second temperature sensor 23 detects a temperature Ts of the refrigerant taken by the compressor 1. The third temperature sensor 24 detects a case temperature Tcp of the compressor 1.

A by-pass tube 25 for connecting the service port 9b of the packed valve 9 to the service port 12b of the packed valve 12 is prepared as equipment for a refrigerant amount check operation. The by-pass tube 25 consists of the same material as that of the tubes constituting the refrigerating cycle or is a rubber tube, and the by-pass tube 25 is detachably connected to the service ports 9b and 12b.

A control circuit is shown in FIG. 12.

The outdoor unit A has an outdoor controller 60 constituted by a microcomputer and its peripheral circuits. The four-way valve 2, the two-way valves 4, 5, and 15, and the high-pressure switch 20, the pressure sensor 21, the temperature sensors 22, 23 and 24, an operation switch 26 for starting a refrigerant amount check operation, a display unit 27 for informing a determination result in the refrigerant amount check operation, and an inverter 61.

The inverter 61 rectifies the voltage of a commercial AC power supply 62 and, converts the voltage into a voltage having a frequency (and level) corresponding to a command from the outdoor controller 60, and outputs the converted voltage. The output from the inverter 61 is to be used as a drive power of a compressor motor 1M.

A distribution controller 70 of a distribution unit B and the water supply unit D are connected to the outdoor controller 60 through signal lines. The distribution controller 70 is constituted by a microcomputer and its peripheral circuits. The PMVs 31, 41, and 51 are connected to the distribution controller 70.

Indoor controllers 80 of indoor units $C_1$, $C_2$, and $C_3$ are connected to the distribution controller 70 through signal lines, respectively. Each of the indoor controllers 80 is constituted by a microcomputer and its peripheral circuits. A remote-control type operation unit 81, an indoor temperature sensor 82, and an indoor fan motor 30M are connected to each of the indoor controllers 80. Each of the indoor temperature sensors 82 detects an indoor temperature Ta.

On the other hand, each of the indoor controllers 80 has the following functional means.

[1] A means for sending an operation start command and an operation stop command on the basis of the operation of each of the operation units 81 to the distribution unit B.

[2] A means for sending a cooling operation mode request or a heating operation mode request set with each of the operation units 81 to the distribution unit B.

[3] A means for detecting, as an air-conditioning load, a difference between the temperature Ts set with each of the operation units 81 and the detection temperature Ta of each of the indoor temperature sensors 82, and informing the distribution unit B of the air-conditioning load.

The outdoor controller 60 has the following functional means.

[1] A means for driving the inverter 61 in response to the operation start command to start the operation of the compressor 1 and to start the operation of the water supply unit D.

[2] A means for controlling a frequency F (Hz) of an output voltage from the inverter 61 in accordance with a total sum of air-conditioning loads informed by the indoor units $C_1$, $C_2$, and $C_3$.

[3] A means for controlling frequencies F (Hz) of the output voltages of the degrees of opening of the PMVs 31, 41, and 51 in accordance with the total sum of air-conditioning loads informed by the indoor units $C_1$, $C_2$, and $C_3$.

[4] A means for preventing the four-way valve 2 from being rendered conductive to set the four-way valve 2 in a neutral state when the means is informed that a heating operation mode is determined.

[5] A means for rendering the four-way valve 2 conductive to switch the four-way valve 2 when the means is informed that a heating operation mode is determined.

[6] A high-pressure protection means for stopping the operation of the compressor 1 when the high-pressure switch 20 is operated.

[7] A means for controlling the opening/closing operations of the two-way valves 4 and 5 in accordance with the high-pressure-side pressure Pd detected by the pressure sensor 21.

[8] A by-pass means for causing a refrigerant discharged from the compressor 1 to pass through the water heat exchangers 3a, 3b, and 3c and causing the refrigerant passing through the water heat exchangers 3a, 3b, and 3c not to flow into the indoor heat exchangers 34, 44, and 54 but to flow into the low-pressure side of the refrigerating cycle through the by-pass tube 25. A refrigerant amount check operation in which the refrigerant discharged from the compressor 1 is circulated in only the refrigerating cycle of the heat source unit A is performed by the operation of the by-pass means.

[9] A determination means for determining, during the refrigerant amount check operation, in accordance with the detection temperatures from the temperature sensors 22, 23, and 24, whether the refrigerant amount of the refrigerating cycle is normal or abnormal.

[10] A means for displaying the determination result of the determination means on the display unit 27.

[11] A means for stopping the driving of the inverter 61 in response to the operation stop command to stop the operation of the compressor 1 and the operation of the water supply unit D.

Operations will be described below.

Figure 3:
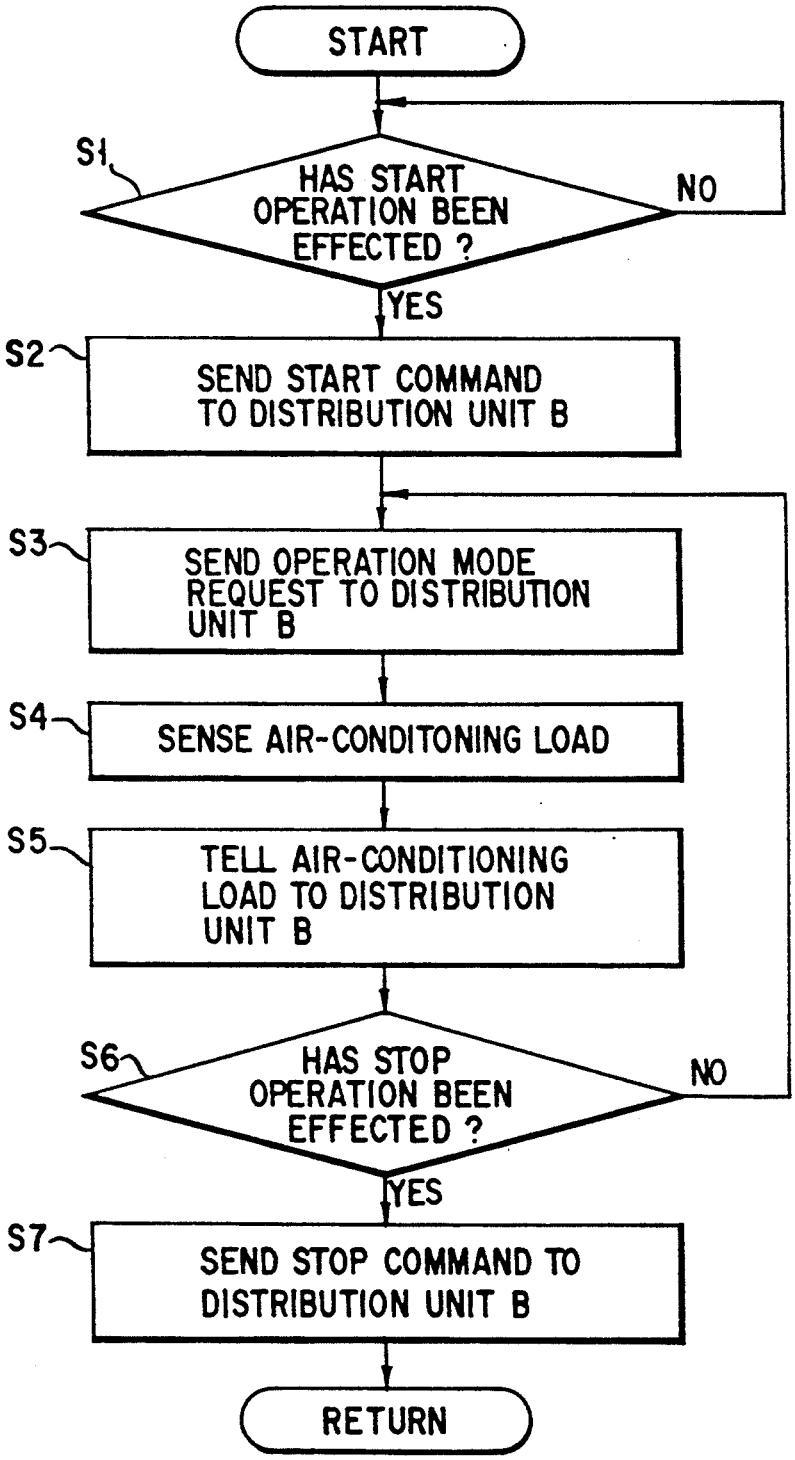
FIG. 3 is a flow chart for explaining operations of indoor controllers according to the first and second embodiments.

The operation of each of the indoor units $C_1$, $C_2$, and $C_3$ will be described below with reference to FIG. 3.

When an operation is started with the operation unit 81 (YES in step S1), an operation start command is sent to the distribution unit B (step S2). At the same time, a cooling operation mode request or a heating operation mode request set with the operation unit 81 is sent to the distribution unit B (step S3).

A difference between a set indoor temperature set with the operation unit 81 and the detection temperature from the indoor temperature sensor 82 is calculated by an air-conditioning load (step S4). The calculated air-conditioning load is informed to the distribution unit B (step S5). When the operation is stopped with the operation unit 81 (YES in step S6), an operation stop command is sent to the distribution unit B (step S7).

Figure 4A:
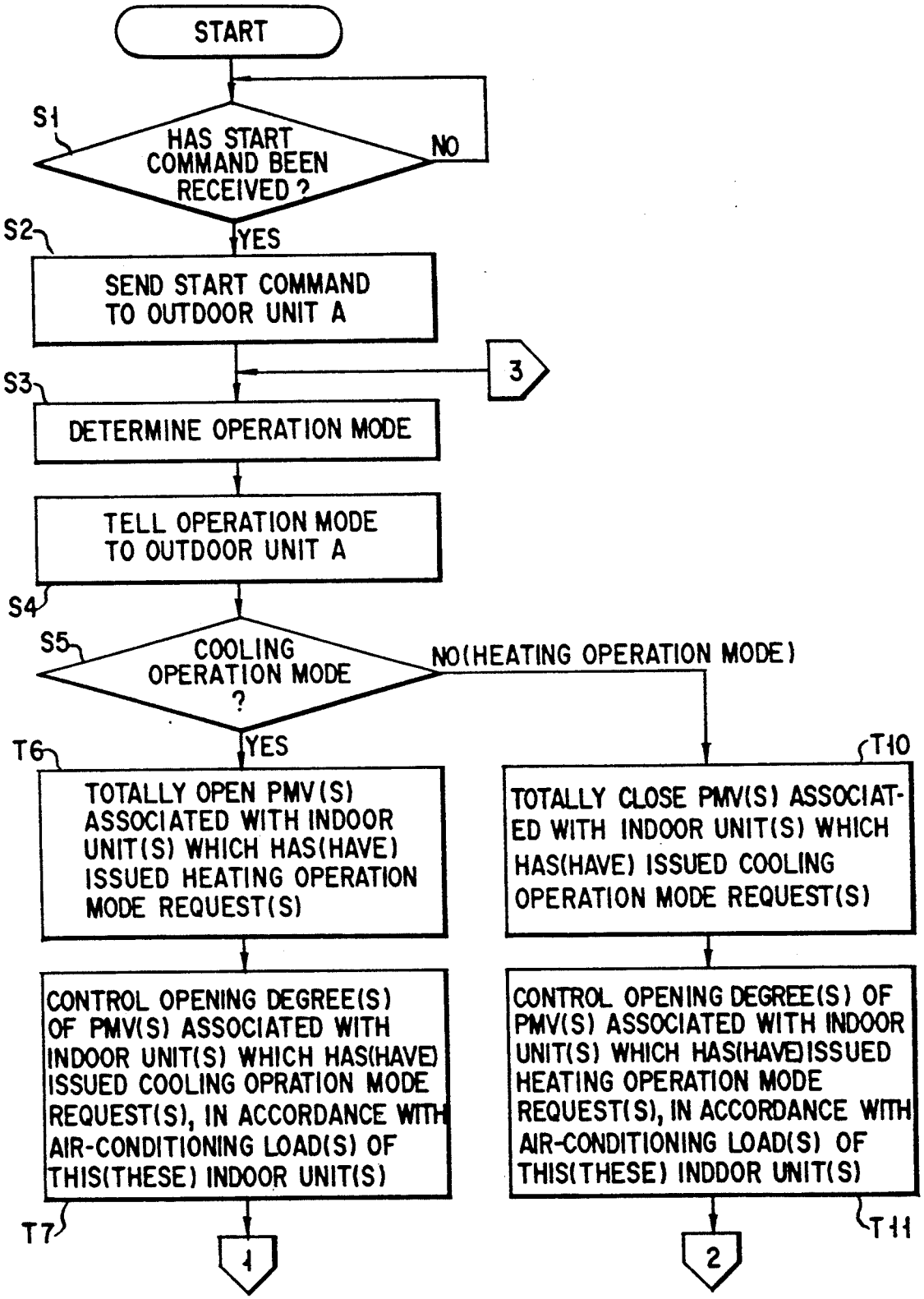
FIGS. 4A and 4B are flow charts for explaining operations of the distribution control sections of the first and second embodiments.
Figure 4B:
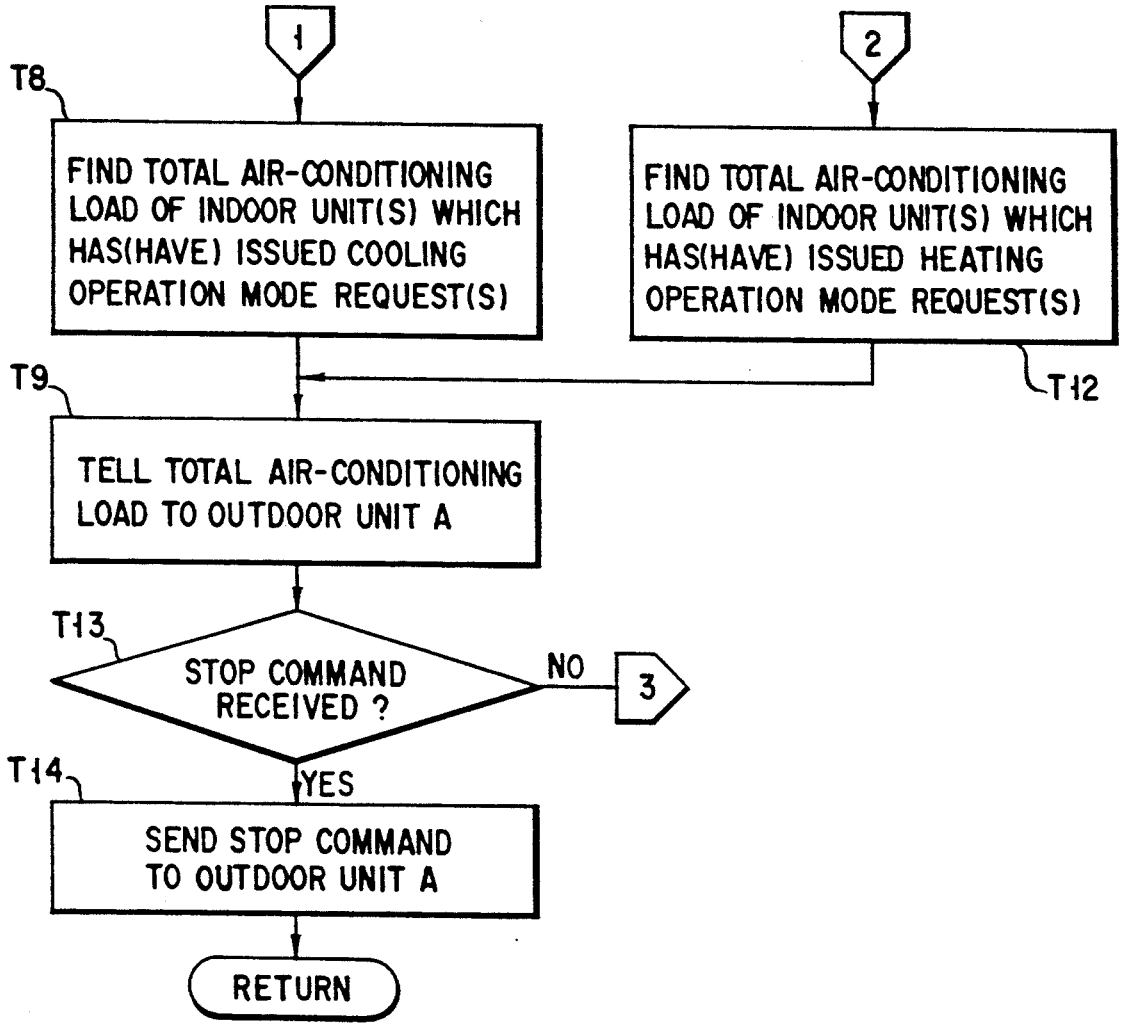

An operation of the distribution unit B will be described below with reference to FIGS. 4A and 4B.

When the distribution unit B receives the operation start command from at least one of the indoor units $C_1$, $C_2$, and $C_3$ (YES in step T1), the operation start command is sent to the outdoor unit A (step T2). At the same time, any one of the cooling operation mode and the heating operation mode is determined in accordance with the requests of the indoor units $C_1$, $C_2$, and $C_3$ (step T3).

For example, the number of cooling operation mode requests is compared with the number of heating operation mode requests, and the operation mode is determined in accordance with this comparison result. Otherwise, the priority levels of the indoor units $C_1$, $C_2$, and $C_3$ are determined in advance, and an operation mode request generated by an indoor unit having the highest priority level is selected from the indoor units generating operation mode requests so as to determine the operation mode. The determined operation mode is informed to the outdoor controller 60 (step T4).

When the cooling operation mode is determined (YES in step T5), a PMV, corresponding to an indoor unit generating a heating operation mode request, of the PMVs 31, 41, and 51 is fully closed (step T6). At the same time, the degrees of opening of PMVs, corresponding to indoor units generating cooling operation mode requests, of the PMVs 31, 41, and 51 are controlled in accordance with the air-conditioning loads of the indoor units (step T7).

A sum of the air-conditioning loads of the indoor units generating cooling operation mode requests is calculated (step T8). The calculated sum of the air-conditioning loads is informed to the outdoor unit A (step T9).

The heating operation mode is determined (NO in step T5), a PMV, corresponding to an indoor unit generating a cooling mode request, of the PMVs 31, 41, and 51 is fully closed (step T10). At the same time, the degrees of opening of PMVs, corresponding to indoor units generating heating operation mode requests, of the PMVs 31, 41, and 51 are controlled in accordance with the air-conditioning loads of the indoor units (step T11).

A sum of the air-conditioning loads of the indoor units generating heating operation mode requests is calculated (step T12). The calculated sum of the air-conditioning loads is informed to the outdoor unit A (step T9).

When the distribution unit B receives operation stop commands from all the indoor units $C_1$, $C_2$, and $C_3$ (YES in step T13), the operation stop commands are sent to the outdoor unit A (step T14).

Figure 5A:
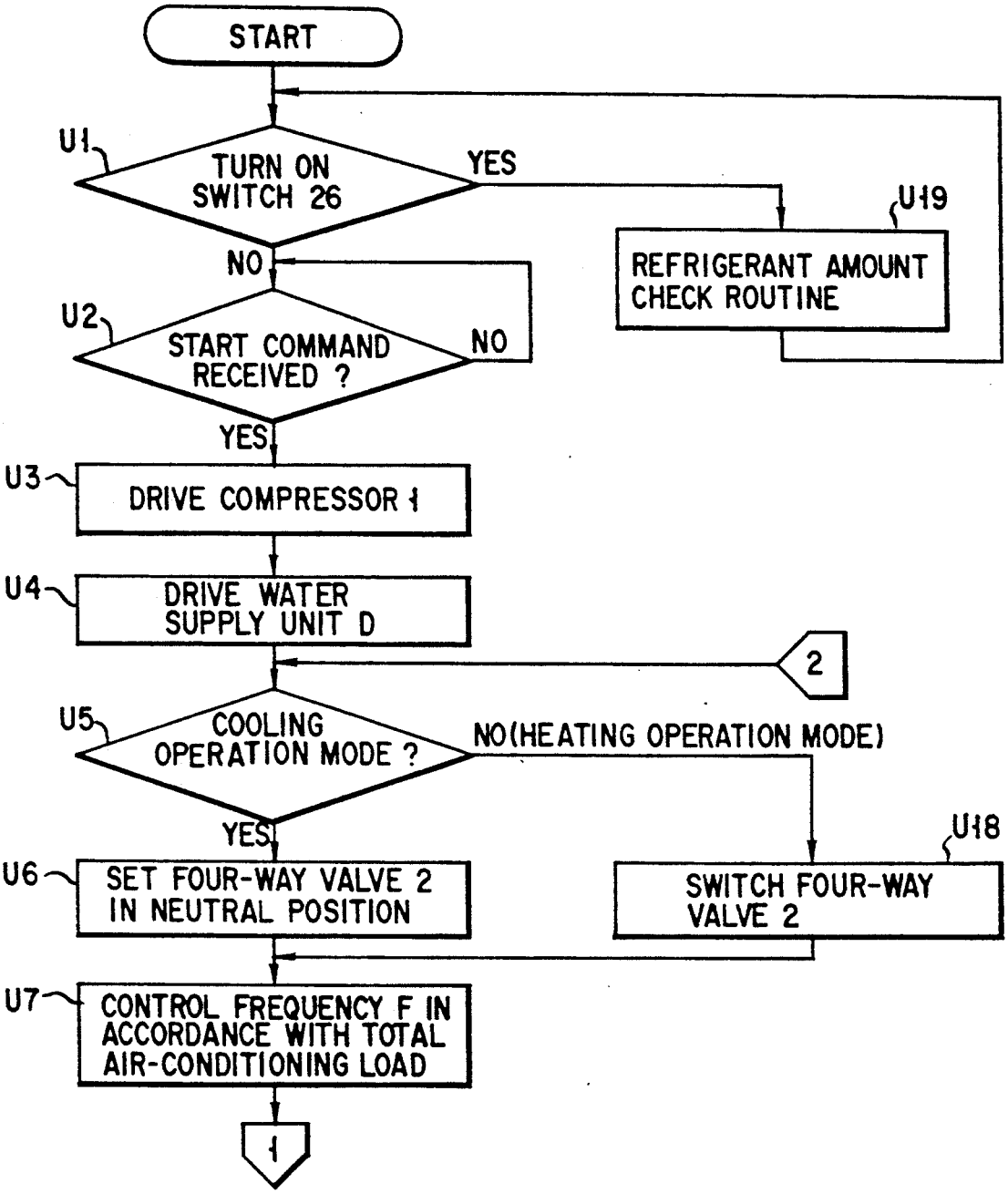
FIGS. 5A and 5B are flow charts for explaining operations of the outdoor control sections of the first and second embodiments.
Figure 5B:
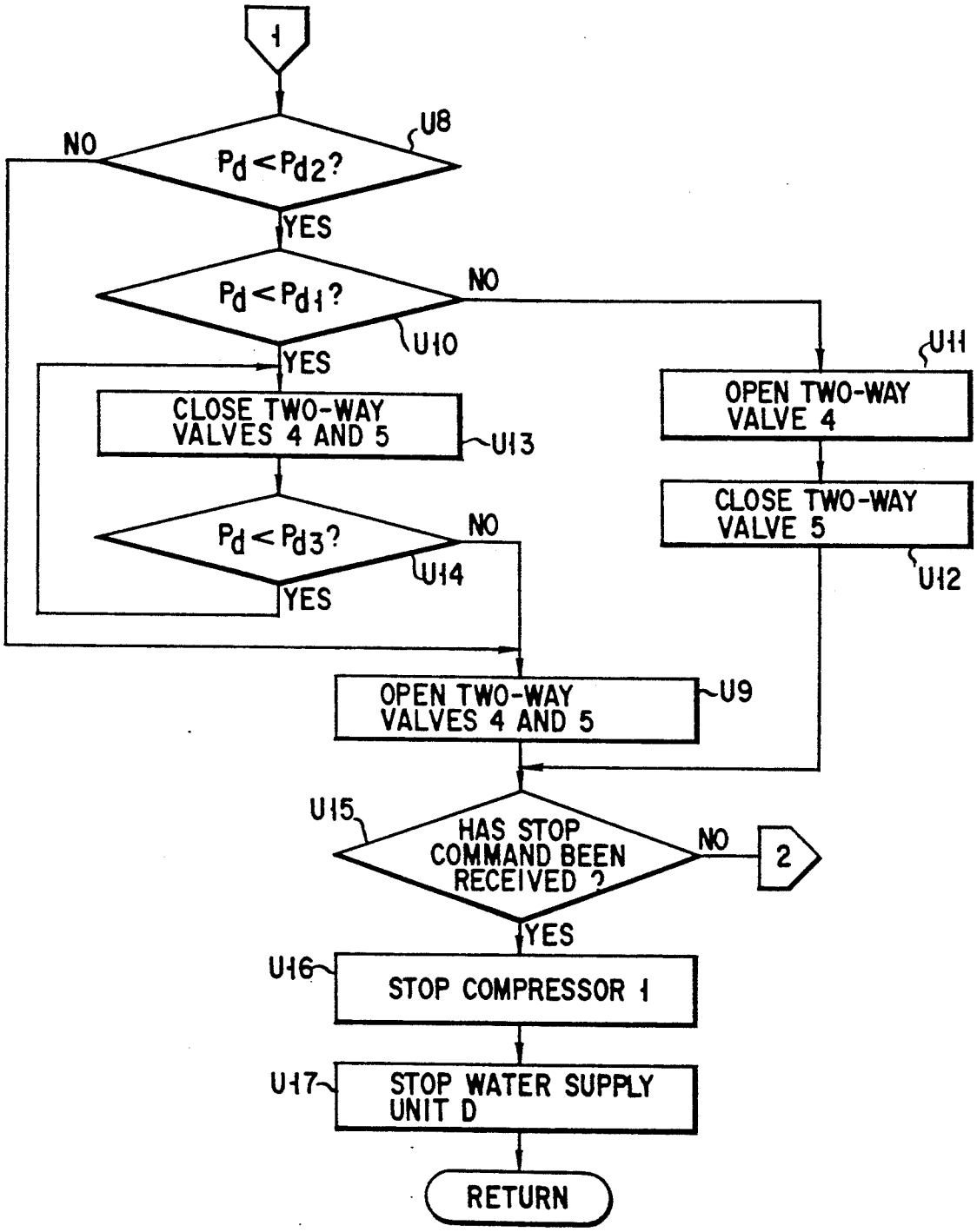

An operation of the outdoor unit A will be described below with reference to FIGS. 5A and 5B.

It is assumed that the operation switch 26 is not turned on (NO in step U1). When the outdoor unit A receives an operation start command from the distribution unit B (step U2), the inverter 61 is driven to start the operation of the compressor 1 (step U3). In addition, the operation of the water supply unit D is started (step U4).

When the outdoor unit A receives a cooling operation mode request (YES in step U5), the four-way valve 2 is set in a neutral state (step U6).

In this case, as indicated by the arrows of the solid lines in FIG. 1, the refrigerant is discharged from the compressor 1 and supplied into the water heat exchangers 3*a*, 3*b*, and 3*c* through the four-way valve 2. Water supplied from the water supply unit D deprives heat of the refrigerant supplied to the water heat exchangers 3*a*, 3*b*, and 3*c* so as to liquefy the refrigerant. The liquid refrigerant passing through the water heat exchangers 3*a*, 3*b*, and 3*c* passes through the check valve 6, the liquid tank 8, and then an open PMV of the PMVs 31, 41, and 51.

It is assumed that the PMVs 31 and 41 are open and that the PMV 51 is fully closed.

The pressure of the liquid refrigerant passing through the PMVs 31 and 41 is decreased in the expansion valves 32 and 42, and the liquid refrigerant is supplied into the indoor heat exchangers 34 and 44. The refrigerant supplied to the indoor heat exchangers 34 and 44 deprives heat of the indoor air so as to evaporate the refrigerant. The gas refrigerant passing through the indoor heat exchangers 34 and 44 is taken by the compressor 1 through the four-way valve 2 and the accumulator 13.

That is, the water heat exchangers 3*a*, 3*b*, and 3*c* function as condensers, the indoor heat exchanger 34 functions as an evaporator, and a room in which the indoor units $C_1$ and $C_2$ are installed is cooled.

During this cooling operation, the frequency F (Hz) of the output voltage from the inverter 61 is set in accordance with a sum of air-conditioning loads (step U7). That is, the capability of the compressor 1 corresponding to the cooling load of the room in which the indoor units $C_1$ and $C_2$ are installed is obtained.

The high-pressure-side pressure Pd detected by the pressure sensor 21 is compared with a set value $Pd_2$ (step U8). When two or more units of the indoor units $C_1$, $C_2$, and $C_3$ are operated, the high-pressure-side pressure Pd is higher than the set value Pd2 ($Pd > Pd2$). At this time, both the two-way valves 4 and 5 are opened (step U9). When the two-way valves 4 and 5 are open, the refrigerant passes through all the water heat exchangers 3*a*, 3*b*, and 3*c*, and a maximum condensation capability can be obtained.

When the above operation is switched to a single-unit operation in which any one of the indoor units $C_1$, $C_2$, and $C_3$ is operated, the condensation capability is excessive, and the high-pressure-side pressure Pd is decreased. When the high-pressure-side pressure Pd becomes lower than the set value $Pd_2$ ($Pd < Pd_2$), the high-pressure-side pressure Pd is compared with a set value $Pd_1$ ($< Pd_2$) (step U10).

When the high-pressure-side pressure Pd is higher than the set value $Pd_1$ ($Pd_2 > Pd > Pd_1$), the two-way valve 4 is kept open (step U11), and the two-way valve 5 is closed (step U12). When the two-way valve 4 is opened, and the two-way valve 5 is closed, the refrigerant passes through the two water heat exchangers 3*a* and 3*b* but does not pass through the water heat exchanger 3*c*. That is, the condensation capability is set at an intermediate level.

When the high-pressure-side pressure Pd is more decreased to be lower than the set value $Pd_1$ ($Pd < Pd_1$), both the two-way valves 4 and 5 are closed (step U13). When the two-way valves 4 and 5 are closed, the refrigerant passes through only the water heat exchanger 3*a* but does not through the water heat exchangers 3*b* and 3*c*. That is, the condensation capability is minimized.

At this time, the high-pressure-side pressure Pd is compared with a set value $Pd_3$ ($> Pd_2$) (step U14). When the high-pressure-side pressure Pd is lower than the set value $Pd_3$ ($Pd < Pd_3$), the two-way valves 4 and 5 are kept closed (step U13).

When the number of operated units of the indoor units $C_1$, $C_2$, and $C_3$ is increased, the condensation capability become insufficient, and the high-pressure-side pressure Pd is increased. When the high-pressure-side pressure Pd exceeds the set value $Pd_3$ ($Pd > Pd_3$), both the two-way valves 4 and 5 are opened (step U9).

As described above, when the water heat exchangers 3*a*, 3*b*, and 3*c* are selectively operated, an excessive increase in condensation capability is suppressed to keep the necessary and sufficient high-pressure-side pressure Pd.

On the other hand, when the outdoor unit A receives a heating operation mode (NO in step U5), the four-way valve 2 is switched (step U18). In the following description, it is assumed that the PMVs 31 and 41 are open and that the PMV 51 is fully closed.

In this case, as indicated by the arrows of the dotted lines in FIG. 1, the refrigerant discharged from the compressor 1 is supplied into the indoor heat exchangers 34 and 44 through the four-way valve 2, and the indoor air deprives heat of the refrigerant so as to liquify the refrigerant. The liquid refrigerant passing through the indoor heat exchangers 34 and 44 is supplied into the water heat exchangers 3a, 3b, and 3c through the check valves 33 and 43, the PMVs 31 and 41, the receiver 8, and the expansion valve 7.

The refrigerant supplied to the water heat exchangers 3a, 3b, and 3c deprives heat of water supplied from the water supply unit D so as to evaporate the refrigerant. The gas refrigerant passing through the water heat exchangers 3a, 3b, and 3c is taken by the compressor 1 through the four-way valve 2 and the accumulator 13.

The indoor heat exchangers 34 and 44 function as condensers, the water heat exchangers 3a, 3b, and 3c functions as evaporators, and a room in which the indoor units $C_1$ and $C_2$ are installed is heated.

During this heating operation, the frequency F (Hz) of the output voltage from the inverter 61 is set in accordance with a sum of air-conditioning loads (step U7). That is, the capability of the compressor 1 corresponding to the heating load of the room in which the indoor units $C_1$ and $C_2$ are installed is obtained.

During the heating operation, the high-pressure-side pressure Pd detected by the pressure sensor 21 is compared with the set values $Pd_1$, $Pd_2$ and $Pd_3$, and the opening/closing operations of the two-way valves 4 and 5 are controlled in accordance with the comparison result. For this reason, the water heat exchangers 3a, 3b, and 3c are selectively operated, and an excessive increase in evaporation capability is suppressed to keep the necessary and sufficient high-pressure-side pressure Pd. Note that the set values $Pd_1$, $Pd_2$, and $Pd_3$ in the cooling operation are different from the set values $Pd_1$, $Pd_2$, and $Pd_3$ in the heating operation, respectively.

When the outdoor unit A receives an operation start command from the distribution unit B (step U15), the driving of the inverter 61 is stopped to stop the operation of the compressor 1 (step U16). In addition, the operation of the water supply unit D is stopped (step U17).

Upon completion of the installation of the air-conditioning apparatus, an operator connects the by-pass tube 25 between the service ports 9a and 12a of the packed valves 9 and 12 to perform a refrigerant amount check operation of the refrigerating cycle and sets the operation rods 9a and 12a to predetermined positions to render the operation rods 9a and 12a conductive. The operator turns on the operation switch 26 of the heat source unit A.

Figure 6:
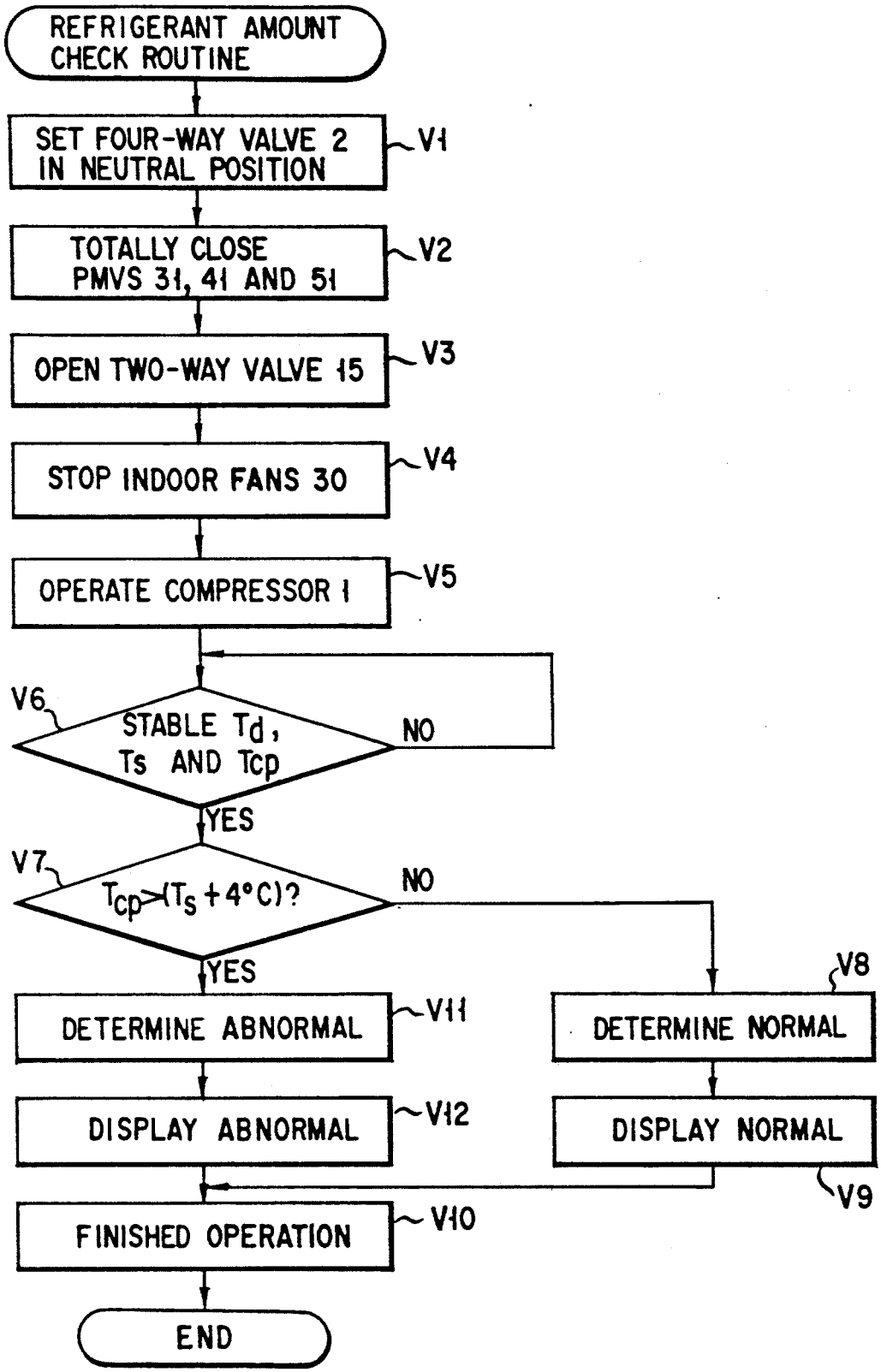
FIG. 6 is a flow chart showing a refrigerant amount check routine according to the first embodiment of the present invention.

When the operation switch 26 is turned on (YES in step U1), a refrigerant amount check routine is performed (step U19). This refrigerant amount check routine is shown in FIG. 6.

First, the four-way valve 2 is set in a neutral state (step V1), and the PMVs 31, 41, and 51 of the distribution unit B are fully closed (step V2). The two-way valve 15 is opened (step V13), and the indoor fans 30 in the indoor units $C_1$, $C_2$, and $C_3$ are stopped (step V4). The operation of the compressor 1 is started (step V5). In this manner, the refrigerant amount check operation is started.

In this case, the gas refrigerant discharged from the compressor 1, as indicated by arrows of alternate long and two short dashed lines in FIG. 1, flows from the four-way valve 2 to the water heat exchangers 3a, 3b, and 3c, and cooled water deprives heat of the gas refrigerant so as to liquify the refrigerant. The liquid refrigerant passes into the packed valve 9 through the check valve 6 and the receiver 8.

Although the liquid refrigerant flowing in the packed valve 9 tends to flow into the distribution unit B, since the PMVs 31, 41, and 51 are fully closed, a liquid refrigerant is left in the liquid line R between the packed valve 9 and the PMVs 31, 41 and 51, and most of the refrigerant flows into the by-pass tube 25 through the service port 9b. An amount of liquid refrigerant left in the liquid line R is almost equal to a refrigerant amount which is increased in accordance with a piping length.

The liquid refrigerant passing through the by-pass tube 25 is supplied into the service port 12b to flow from the packed valve 12 to the four-way valve 2 in a low-pressure direction. The packed valves 9 and 12 have flow resistances, and the flow resistances decrease the pressure of the liquid refrigerant.

The liquid refrigerant flowing from the packed valve 12 to the four-way valve 2 is taken by the compressor 1 through the four-way valve 2 and the accumulator 13. At this time, part of a high-temperature-gas refrigerant discharged from the compressor 1 passes through the by-pass tube 14 and the two-way valve 15 so as to merge into the liquid refrigerant flowing from the four-way valve 2 to the accumulator 13.

The merged high-temperature gas refrigerant heats the liquid refrigerant passing through the four-way valve 2, such that the accumulator 13 and the low-pressure-side tube function as evaporators.

In this manner, the refrigerant is circulated in only the refrigerating cycle of the heat source unit A, and a condensation operation caused by the water heat exchangers 3a, 3b, and 3c, a pressure-reduction operation caused by the packed valves 9 and 12, and an evaporation operation caused by the accumulator 13 and the low-pressure-side tube are present during the circulation. In this manner, a cycle similar to the cycle of the cooling operation can be formed.

During the refrigerant amount check operation, the temperature Td of the refrigerant discharged from the compressor 1 is detected by the first temperature sensor 22, the temperature Ts of the refrigerant taken by the compressor 1 is detected by the second temperature sensor 23, and the case temperature Tcp of the compressor 1 is detected by the third temperature sensor 24. The detection temperatures Td, Ts, and Tcp are to be stabilized.

When the detection temperature Td, Ts, and Tcp are stabilized (step V6), the case temperature Tcp is compared with a reference value obtained by adding, e.g., 4° C., to a predetermined value (step V7).

When the case temperature Tcp is lower than the reference value (=Ts+4° C.) (NO in step V7), it is determined (step V8) that the refrigerant amount in the refrigerating cycle is normal, and the determination result is displayed on the display unit 27 (step V9). Upon the display operation, the refrigerant amount check operation is finished (step V10).

Figures 7A, 7B, 7C:
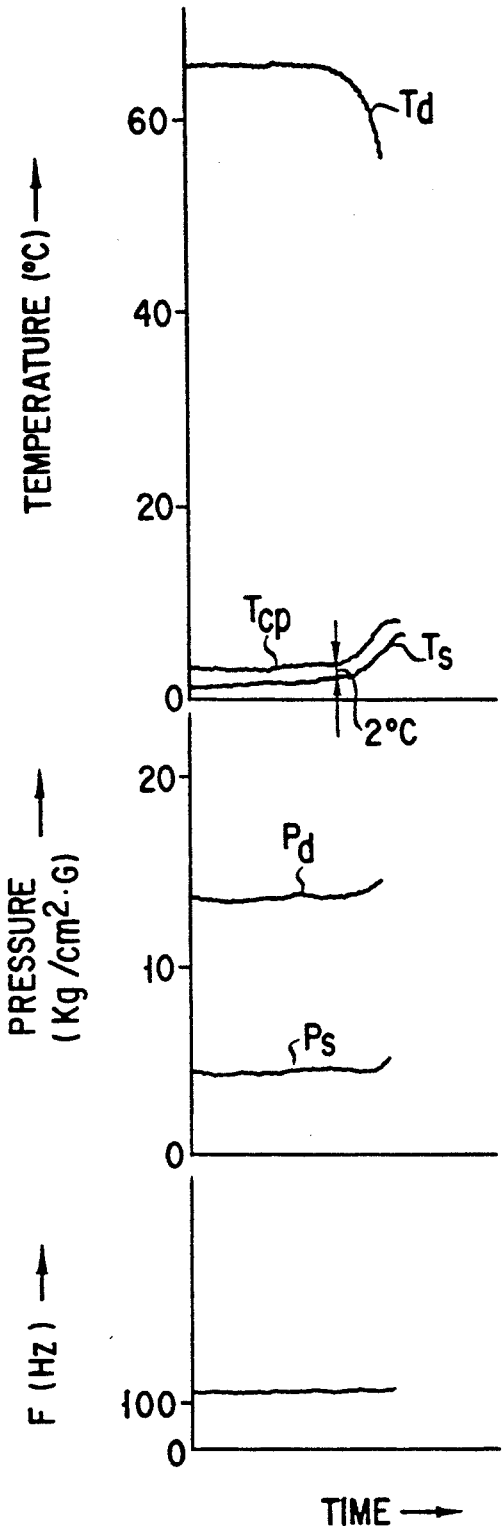
FIGS. 7A to 7C is a graph showing changes in temperature and pressure of each part in the first embodiment when a refrigerant amount is normal.

FIGS. 7A to 7C show a change in temperature of each part and a change in pressure of each part which are confirmed by an experiment when the refrigerant amount in the refrigerating cycle is proper. The case temperature Tcp of the compressor 1 is kept higher than the suction refrigerant temperature Ts by 2° C.

When the case temperature Tcp of the compressor 1 exceeds the reference value (=Ts+4° C.) (YES in step V7), it is determined (step V11) that the refrigerant amount in the refrigerating cycle is abnormal, and the determination result is displayed on the display unit 27 (step V12). Upon the display operation, the refrigerant amount check operation is finished (step V10).

Figures 8A, 8B, 8C:
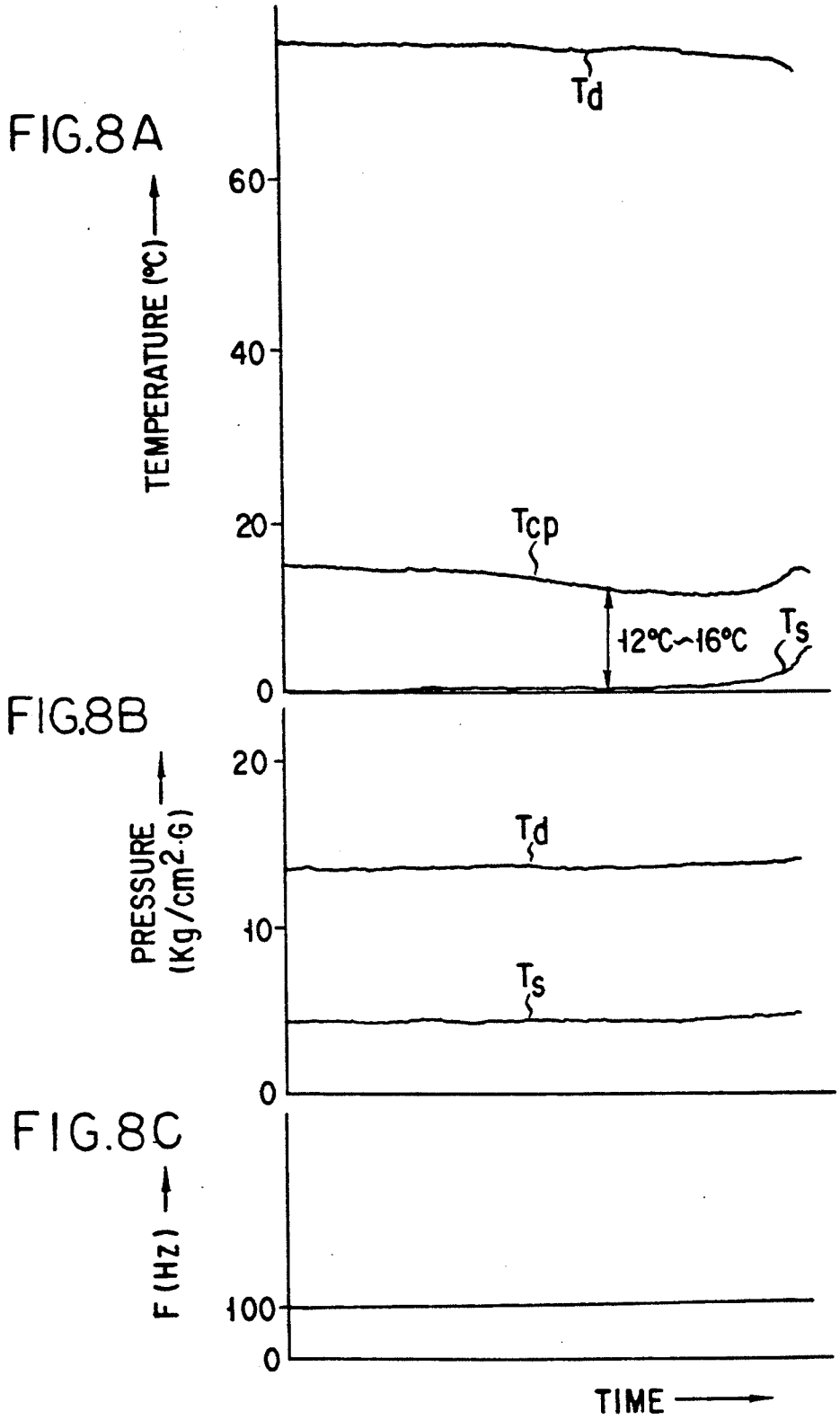
FIGS. 8A to 8C is a graph showing changes in temperature and pressure of each part in the first embodiment when a refrigerant amount is abnormal.

FIGS. 8A to 8C show a change in temperature of each part and a change in pressure of each part which are confirmed by an experiment when the refrigerant amount in the refrigerating cycle is insufficient. The case temperature Tcp of the compressor 1 becomes higher than the suction refrigerant temperature Ts by 12° C. to 16° C.

As described above, when the refrigerant is circulated in only the refrigerating cycle of the heat source unit A even in a multi-type apparatus having a plurality of indoor units, although the apparatus has a complex arrangement, a refrigerant amount can be automatically and accurately detected without being influenced by an indoor environment regardless of the combinations of the shapes and capacities of the indoor units.

In this manner, an operator performs a recharging operation of a refrigerant only when the abnormal state is displayed, and an unnecessary recharging operation of the refrigerant need not be performed. Therefore, the time required for installation can be shortened, and the cost for installation can be reduced. In addition, since the unnecessary recharging operation of the refrigerant is not performed, the environmental problem concerning handling of the flon gas can be solved as much as possible.

Figure 9:
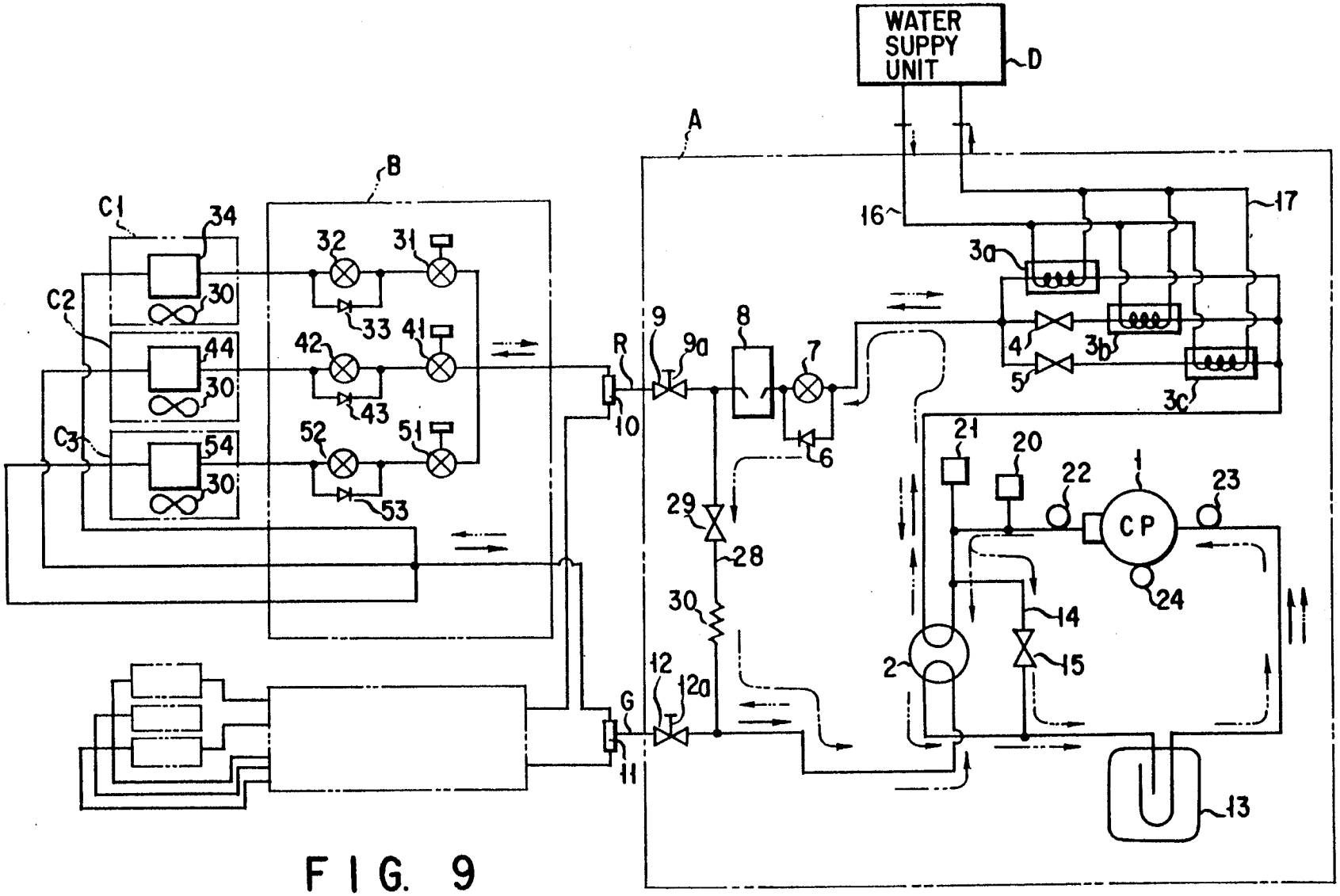
FIG. 9 is a view showing the arrangement of a refrigerating cycle according to the second embodiment of the present invention.

In the first embodiment, an operator manually detaches the by-pass tube 25 for forming the circulation path of the refrigerant. As shown in FIG. 9 as the second embodiment, a by-pass tube 28 may be connected in advance, and the by-pass tube 28 may be electrically opened or electrically closed by an electromagnetic two-way valve 29.

That is, one end of the by-pass tube 28 is connected between the liquid tank 8 and a packed valve 9, and the other end is connected to a low-pressure-side tube between the packed valve 12 and the four-way valve 2. The electromagnetic two-way valve 29 and a capillary tube 30 serving as a pressure-reduction means are arranged in the by-pass tube 28. In this case, the packed valves 9 and 12 having no service ports 9*b* and 12*b* can be employed.

Figure 10:
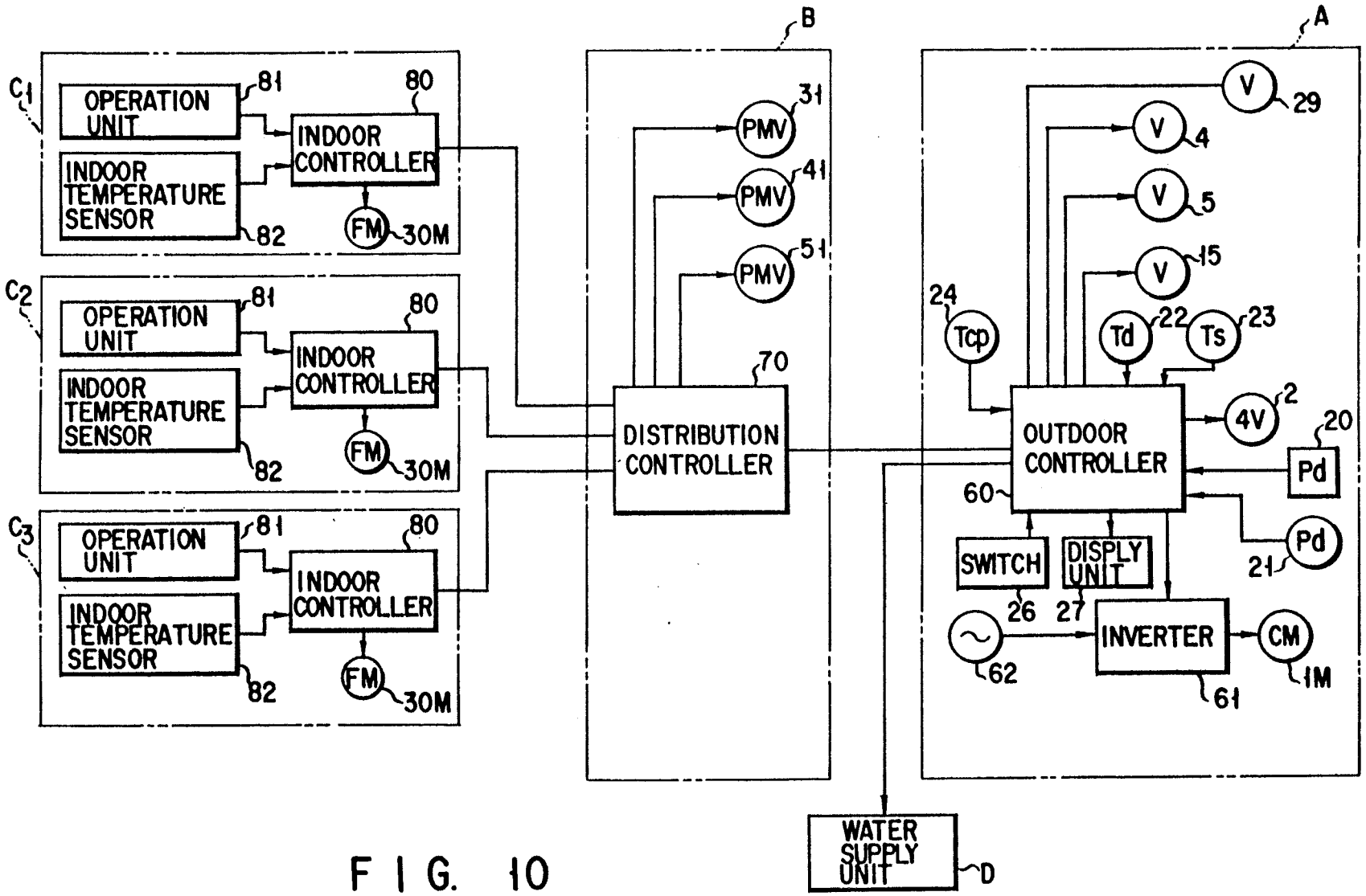
FIG. 10 is a block diagram showing a control circuit of the second embodiment.
Figure 11:
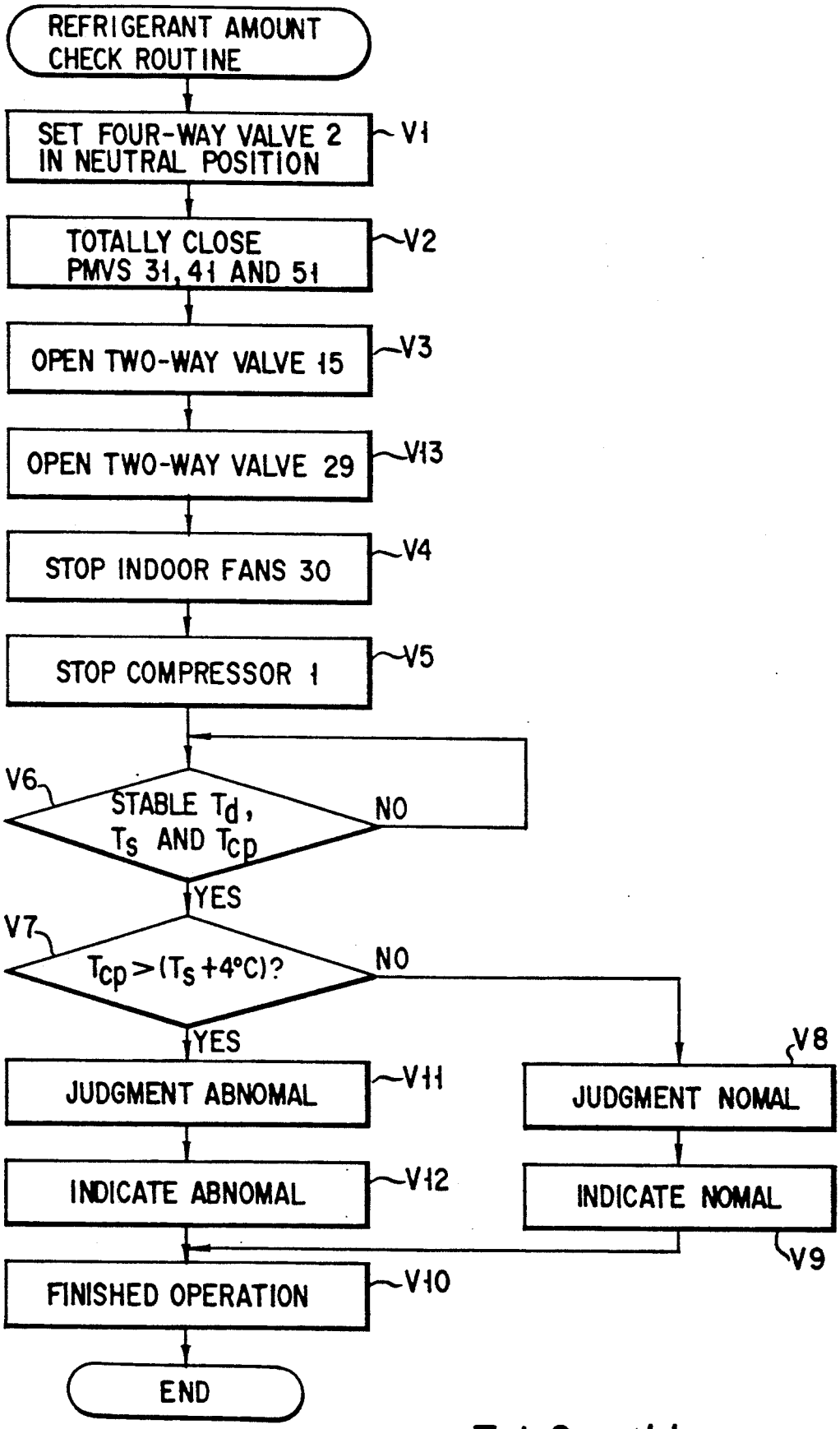
FIG. 11 is a flow chart showing a refrigerant amount check routine according to the second embodiment.

The control circuit according to the second embodiment, as shown in FIG. 10, is the same as that of the first embodiment except that the two-way valve 29 is connected to an outdoor controller 60.

In this case, when an operation switch 26 is turned on, the two-way valve 29 is opened, and the by-pass tube 28 is opened so as to start of a refrigerant amount check operation. That is a refrigerant discharged from a compressor 1 passes through water heat exchangers 3*a*, 3*b*, and 3*c*, and the refrigerant passing through the water heat exchangers 3*a*, 3*b*, and 3*c* does not flow into indoor heat exchangers 34, 44, 54, but flows into the low-pressure side of the refrigerating cycle through the by-pass tube 28.

According to the arrangement of the second embodiment, during the refrigerant amount check operation, an operator need not perform a connection operation of the by-pass tube and the operations of the packed valves 9 and 12.

In each of the above embodiments, although a case wherein three indoor units are used has been described, the number of indoor units is not limited to three. In addition, although three divided water heat exchangers are used, the number of the water heat exchangers may be appropriately set in accordance with the number of indoor units and the capabilities of the indoor units.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An air-conditioning apparatus having a plurality of indoor units connected to a heat source unit, comprising:

a compressor, arranged in said heat source unit, for taking, compressing, and discharging a refrigerant;

a heat-source-side heat exchanger arranged in said heat source unit;

a plurality of indoor heat exchangers arranged in said plurality of indoor units;

a refrigerating cycle obtained by piping said compressor, said heat-source-side heat exchanger, and said plurality of indoor heat exchangers;

by-pass means for causing the refrigerant discharged from said compressor to pass through said heat-source-side heat exchanger, and causing the refrigerant passing through said heat-source-side heat exchanger not to flow into said plurality of indoor heat exchangers but to flow into a low-pressure side of said refrigerating cycle;

detection means for detecting a temperature of a predetermined position in said heat source unit during an operation of said by-pass means; and determination means for determining, in accordance with a detection temperature of said detection means, whether a refrigerant amount in said refrigerating cycle is normal or abnormal.

2. An apparatus according to claim 1, further comprising:

an operation switch, arranged in said heat source unit, for operating said by-pass means.

3. An apparatus according to claim 1, further comprising:

informing means, arranged in said heat source unit, for informing a determination result of said determination means.

4. An apparatus according to claim 1, wherein said by-pass means comprises:

a by-pass tube connected from a tube between said heat-source-side heat exchanger and said plurality of indoor heat exchangers to a low-pressure-side tube; and a valve arranged in said by-pass tube.

5. An apparatus according to claim 1, wherein said compressor takes and compresses a refrigerant in a case and discharges the refrigerant from said case.

6. An apparatus according to claim 5, wherein said detection means comprises:

a first temperature sensor for detecting a temperature of the refrigerant discharged from said compressor;

a second temperature sensor for detecting a temperature of the refrigerant taken by said compressor; and a third temperature sensor for detecting a temperature of said case of said compressor.

7. An apparatus according to claim 6, wherein said determination means compares a detection temperature from said second temperature sensor with a detection temperature from said third temperature sensor to determine whether a refrigerant amount in said refrigerating cycle is normal or abnormal after the detection temperatures from said first temperature sensor, said second temperature sensor, and said third temperature sensor are stabilized.

8. An apparatus according to claim 1, wherein said heat-source-side heat exchanger comprises a plurality of water heat exchangers for exchanging heat of water serving as a heat source with heat of a flowing refrigerant.

9. An apparatus according to claim 8, further comprising a water supply unit for supplying the water serving a heat source into said plurality of water heat exchangers.

10. An apparatus according to claim 8, further comprising:

at least one two-way valve for controlling flow of the refrigerant into said plurality of water heat exchangers;

a pressure sensor for detecting a high-pressure-side pressure of said refrigerating cycle; and control means for controlling an opening/closing operation of said two-way valve in accordance with a detection pressure from said pressure sensor.

11. An apparatus according to claim 1, further comprising:

means for causing the refrigerant discharged from said compressor to flow into said heat-source-side heat exchanger, causing the refrigerant passing through said heat-source-side heat exchanger to flow into said plurality of indoor heat exchangers, and returning the refrigerant passing through said indoor heat exchangers to said compressor, thereby performing a cooling operation mode; and means for causing the refrigerant discharged from said compressor to flow into said plurality of indoor heat exchangers, causing the refrigerant passing through said plurality of indoor heat exchangers to flow into said heat-source-side heat exchanger, and returning the refrigerant passing through said heat-source-side heat exchanger to said compressor, thereby performing a heating operation mode.

* * * * *